US011675299B2

(12) United States Patent
Ikeno

(10) Patent No.: US 11,675,299 B2
(45) Date of Patent: Jun. 13, 2023

(54) HEATING UNIT

(71) Applicant: Brother Kogyo Kabushiki Kaisha, Nagoya (JP)

(72) Inventor: Yuichi Ikeno, Maibara (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/651,952

(22) Filed: Feb. 22, 2022

(65) Prior Publication Data

US 2022/0276597 A1 Sep. 1, 2022

(30) Foreign Application Priority Data

Feb. 26, 2021 (JP) ..... JP2021-029496

(51) Int. Cl.
*G03G 15/20* (2006.01)

(52) U.S. Cl.
CPC ..... *G03G 15/2057* (2013.01)

(58) Field of Classification Search
CPC ..... G03G 15/2057
See application file for complete search history.

(56) References Cited

U.S. PATENT DOCUMENTS

| | | | | |
|---|---|---|---|---|
| 2015/0023704 | A1 | 1/2015 | Imaizumi et al. | |
| 2015/0139706 | A1 | 5/2015 | Fujiwara et al. | |
| 2016/0170351 | A1 | 6/2016 | Suzuki et al. | |
| 2020/0033768 | A1* | 1/2020 | Furuichi | G03G 15/80 |

FOREIGN PATENT DOCUMENTS

| | | | |
|---|---|---|---|
| JP | 2015-043075 | A | 3/2015 |
| JP | 2015-099190 | A | 5/2015 |
| JP | 2016-114619 | A | 6/2016 |

* cited by examiner

*Primary Examiner* — Clayton E. LaBalle
*Assistant Examiner* — Michael A Harrison
(74) *Attorney, Agent, or Firm* — Burr Patent Law, PLLC

(57) ABSTRACT

A heating unit includes a heater, an endless belt, a holder, a heat conductive sheet, and a connector including a connecting terminal connected to a supply terminal. The connector is configured to hold a first end of the heater in the longitudinal direction and a first end of the holder in the longitudinal direction. The holder includes a first surface supporting the heat conductive member, and a second surface supporting the first end of the heater. The second surface is located at a position nearer to the heater than the first surface in a direction orthogonal to the substrate. A height of a step formed between the first surface and the second surface is greater than a thickness of the heat conductive member.

12 Claims, 4 Drawing Sheets

HEATING UNIT

CROSS REFERENCE TO RELATED APPLICATION

The present application claims priority from Japanese Patent Application No. 2021-029496, which was filed on Feb. 26, 2021, the disclosure of which is herein incorporated by reference in its entirety.

BACKGROUND

The following disclosure relates to a heating unit used for a fixing device of an electrophotographic type image forming apparatus or the like.

In the past, there has been known a fixing device in which a rotating belt is interposed between a heater and a pressure roller. The fixing device includes a supporter supporting the heater, a heat conductive member disposed between the heater and the supporter and having a sheet shape, a connector configured to supply electricity to the heater.

A first end of the heater in a longitudinal direction protrudes more than the heat conductive member. A supply terminal is provided at the first end of the heater in the longitudinal direction to which a terminal of the connector is connected. The supporter includes a first surface supporting the heat conductive member and a second surface supporting the first end of the heater in the longitudinal direction.

SUMMARY

Incidentally, in the above described fixing device, in a case where a thickness of the heat conductive member is greater than a dimension of a step between the first surface and the second surface, there is a possibility of connection fault caused by large variations of contact pressure between the terminal of the connector and the supply terminal, since a space is formed between the first end of the heater in the longitudinal direction and the second surface.

An aspect of the disclosure relates to a heating unit capable of suppressing the variations of the contact pressure between the terminal of the connector and the supply terminal from being increased.

In one aspect of the disclosure, a heating unit includes a heater including a substrate, a resistance heating element provided on the substrate, and a supply terminal disposed at a first end of the substrate in a longitudinal direction of the heater, the supply terminal being electrically conducted with the resistance heating element, an endless belt configured to rotate around the heater, a holder supporting the heater, a heat conductive sheet located between the heater and the holder, the heat conductive sheet having a heat conductivity greater than that of the substrate, and a connector including a connecting terminal connected to the supply terminal, the connector being configured to hold a first end of the heater in the longitudinal direction and a first end of the holder in the longitudinal direction. The holder includes a first surface located on a heater side and supporting the heat conductive sheet, and a second surface located on the heater side and supporting the first end of the heater, the second surface being located at a position different from a position of the first surface and nearer to the heater than the first surface in a direction orthogonal to the substrate. A height of a step formed between the first surface and the second surface is greater than a thickness of the heat conductive sheet.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
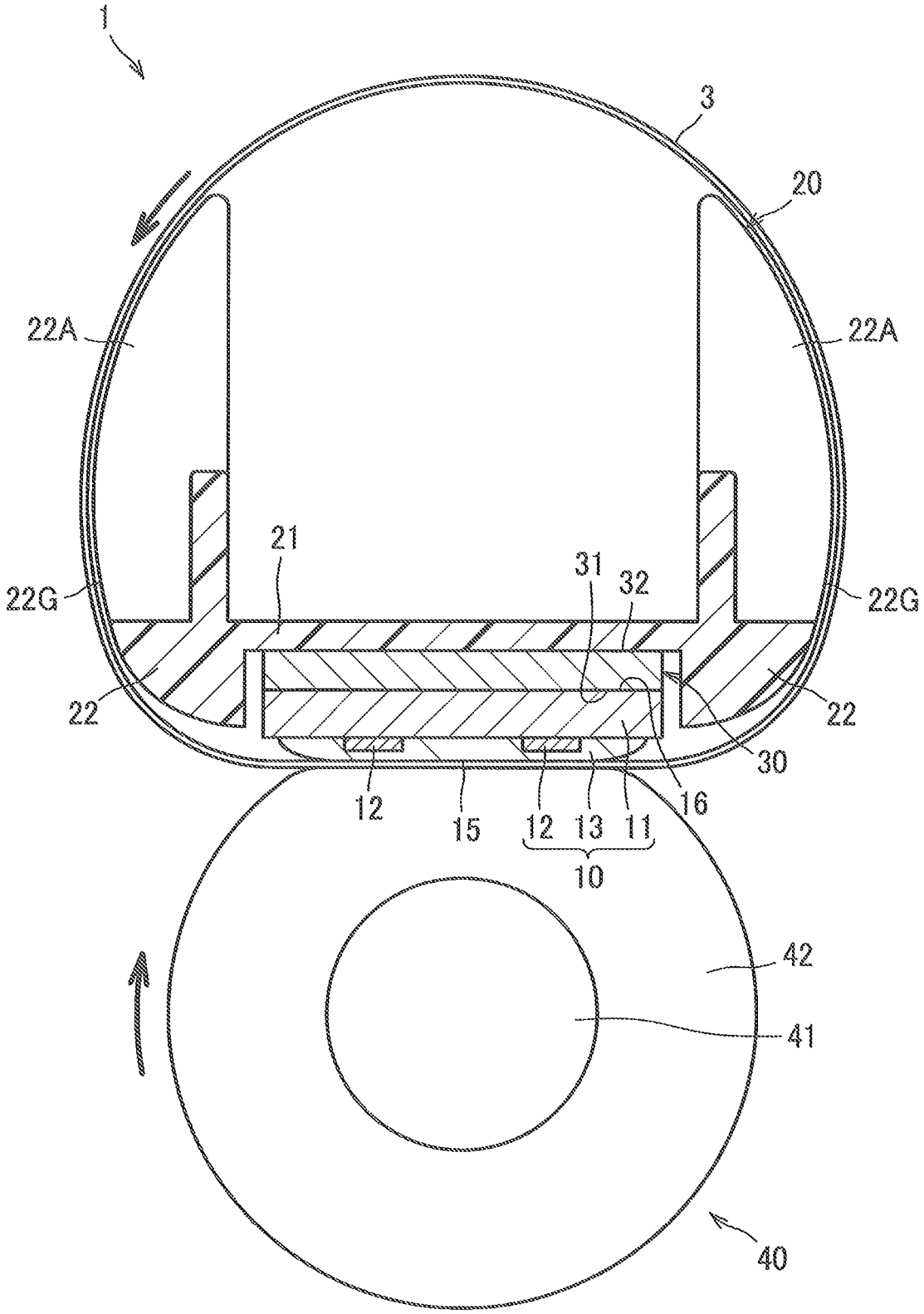
FIG. 1 is a cross-sectional view of a heating unit.

A heating unit 1 according to an embodiment is used for a fixing device of an image forming apparatus, or a device that transfers foil by heat, and the like. As illustrated in FIG. 1, the heating unit 1 includes a belt 3, a heater 10, a holder 20, a heat conductive member 30, and a pressure roller 40 as an example of a pressure member.

The belt 3 is interposed between the pressure roller 40 and the heater 10. The pressure roller 40 includes a shaft 41 having a column shape and a roller 42 having a cylinder shape. The shaft 41 is made of, for example, metal and the like. The roller 42 is made of, for example, rubber and the like. The roller 42 covers a part of the shaft 41. The roller 42 is in contact with the belt 3. One of the holder 20 and the pressure roller 40 is urged toward the other of the holder 20 and the pressure roller 40. In the following description, a direction in which one of the holder 20 and the pressure roller 40 is urged will be referred to as "urging direction".

The belt 3 is an endless belt, which is made of metal or resin. The belt 3 rotates around the heater 10 while being guided by the holder 20. The belt 3 has an outer circumferential surface and an inner circumferential surface. The outer circumferential surface comes into contact with the pressure roller 40 or a sheet to be heated. The inner circumferential surface is in contact with the heater 10.

Figures 2A, 2B, 2C:
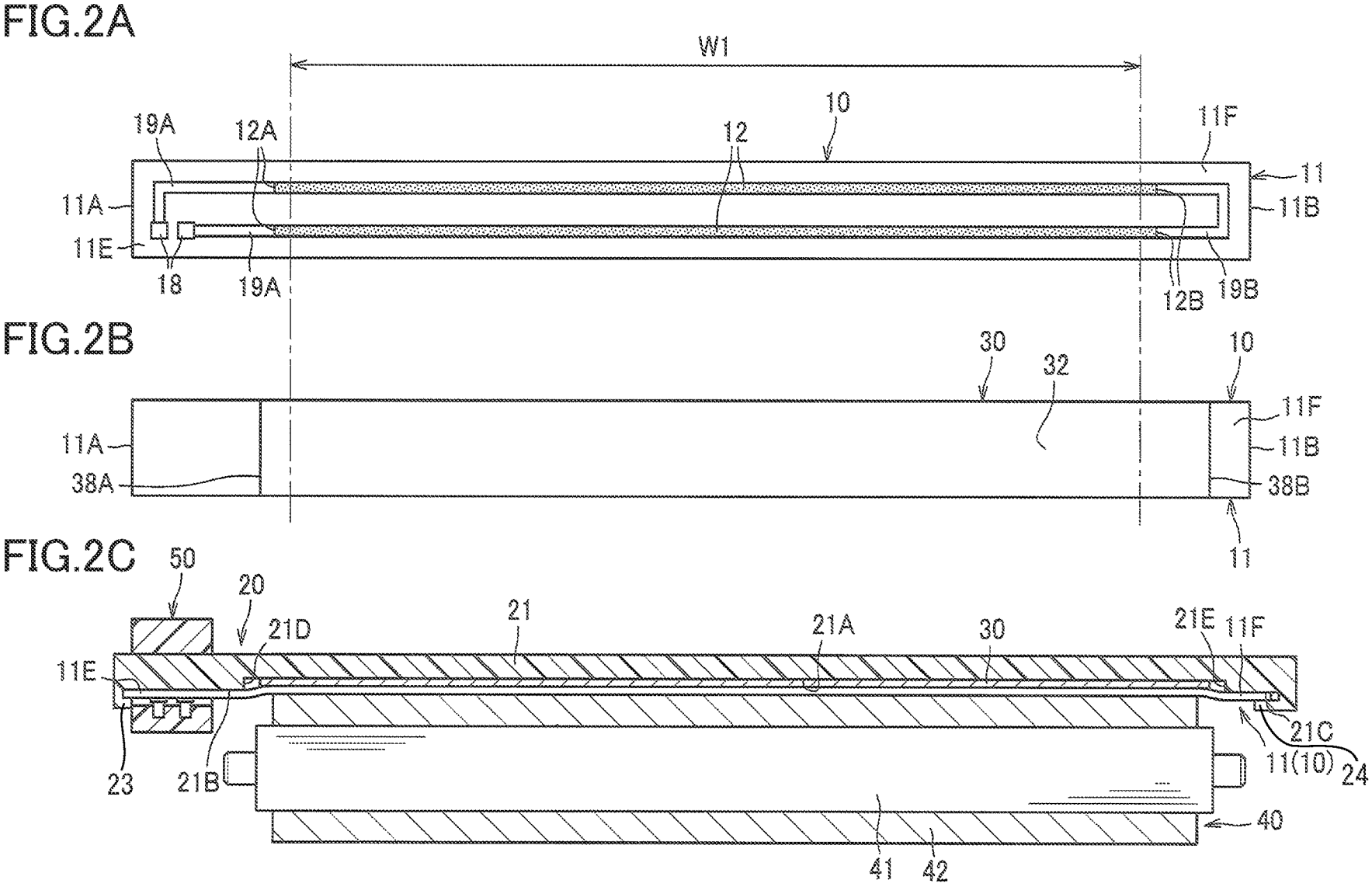
FIG. 2A is a view illustrating a surface on which resistance heating elements of a heater are disposed.
FIG. 2B is a view of the heater and a heat conductive member viewed from a back side of the heater.
FIG. 2C is a cross-sectional view of the heating unit along a longitudinal direction.

The heater 10 includes a substrate 11, resistance heating elements 12 supported by the substrate 11, and a cover 13. The substrate 11 is formed of a long rectangular plate made of ceramic. The heater 10 is a so-called ceramic heater. The resistance heating elements 12 are formed on one surface of the substrate 11 by printing. As illustrated in FIG. 2A, two resistance heating elements 12 are provided in the embodiment. The two resistance heating elements 12 are respectively disposed so as to extend in a longitudinal direction of the heater 10 (hereinafter the longitudinal direction of the heater 10 is referred to merely as "longitudinal direction") and so as to be spaced apart from each other in parallel in a short-side direction orthogonal to the longitudinal direction. A conducting wire 19A is connected to a first end 12A of each of the resistance heating elements 12, and a supply terminal 18 for supplying power is provided at an end portion of the conducting wire 19A of each of the resistance heating elements 12.

The supply terminal 18 is electrically conducted with each of the resistance heat elements 12 through the conducting wire 19A. Each of the supply terminals 18 is located at a first end portion 11E of the substrate 11 in the longitudinal direction.

Second ends 12B of the resistance heating elements 12 are connected to each other by a conducting wire 19B. The number of the resistance heating elements 12 is not particularly limited. The resistance heating elements may be configured such that a resistance heating element in which a heat generation amount at the center in the longitudinal direction is greater than a heat generation amount at end portions in the longitudinal direction and a resistance heating element in which the heat generation amount at end portions in the longitudinal direction is greater than the heat generation amount at the center in the longitudinal direction are provided, and such that a heat generation distribution in the longitudinal direction is regulated by individually controlling each of the resistance heating elements.

As illustrated in FIG. 1, the cover 13 covers the resistance heating elements 12. The cover 13 is made of, for example, glass. The heater 10 includes a nip surface 15 which is in contact with the inner circumferential surface of the belt 3 and a back surface 16 located on an opposite side to the nip surface 15.

The holder 20 is a member supporting the heater 10. The holder 20 includes a support portion 21 and guide portions 22. The support portion 21 has a plate shape corresponding to a shape of the heater 10. The guide portions 22 are provided at both ends of the support portion 21 in the short-side direction. Each of the guide portions 22 has a guide surface 22G extending along the inner circumferential surface of the belt 3. The guide portions 22 have a plurality of guide ribs 22A arranged in the longitudinal direction.

The heat conductive member 30 is a member configured to uniformize the temperature of the heater 10 in the longitudinal direction by conducting heat in the longitudinal direction of the heater 10. The heat conductive member 30 is a sheet-like member, and is located between the back surface 16 of the heater 10 and the support portion 21 of the holder 20. When the sheet as a heating target is interposed between the belt 3 of the heating unit 1 and the pressure roller 40, the heat conductive member 30 is interposed between the heater 10 and the support portion 21. The heat conductive member 30 includes a heater-side surface 31 which is in contact with the back surface 16 of the heater 10, and an opposite surface 32 located on an opposite side to the heater-side surface 31. The opposite surface 32 is in contact with the support portion 21.

The heat conductive member 30 is a member in which a heat conductivity in a direction parallel to the heater-side surface 31 (hereinafter referred to merely as "planar direction") is higher than a heat conductivity of the substrate 11 in the planar direction. A material of the heat conductive member 30 is not particularly limited. For example, metals such as aluminum, aluminum alloys, and copper having high heat conductivities can be adopted.

As illustrated in FIG. 2A and FIG. 2B, the first ends 12A and the second ends 12B of the resistance heating elements 12 are located on outer sides of a range in which the sheet with a maximum width W1 usable in the heating unit 1 passes and on an inner side of a first end 38A and a second end 38B of the heat conductive member 30 in the longitudinal direction. That is, a length of the heat conductive member 30 is longer than a length of the resistance heating element 12 in the longitudinal direction.

Moreover, the first end 38A and the second end 38B of the heat conductive member 30 are located on outer sides of the first ends 12A and the second ends 12B of the resistance heating element 12 and on an inner side of a first end 11A and a second end 11B of the substrate 11 in the longitudinal direction. That is, a length of the substrate 11 is longer than the length of the heat conductive member 30 in the longitudinal direction. The above described supply terminals 18 are disposed at positions spaced apart from the first end 38A of the heat conductive member 30 in the longitudinal direction.

As illustrated in FIG. 2C, the support portion 21 of the holder 20 includes a first surface 21A, a second surface 21B, and a third surface 21C, each of which is a surface located on a side of the heater 10. The support portion 21 further includes a first step face 21D connecting the first surface 21A and the second surface 21B, and a second step face 21E connecting the first surface 21A and the third surface 21C. Each of the first surface 21A, the second surface 21B and the third surface 21C is orthogonal to the urging direction. Each of the first step face 21D and the second step face 21E is orthogonal to the longitudinal direction. The holder 20 further includes a first opposed portion 23 opposed to the second surface 21B at a first end of the holder 20 in the longitudinal direction, and a second opposed portion 24 opposed to the third surface 21C at a second end of the holder 20 in the longitudinal direction. The first surface 21A supports the heat conductive member 30 so as to be in contact with the heat conductive member 30. The second surface 21B supports the first end portion 11E of the substrate 11 so as to be in contact with the first end portion 11E of the substrate 11. The third surface 21C supports a second end portion 11F of the substrate 11 so as to be in contact with the second end portion 11F of the substrate 11. The first opposed portion 23 holds the substrate 11 in a state in which the first end portion 11E of the substrate 11 is nipped between the second surface 21B and the first opposed portion 23. The second opposed portion 24 holds the substrate 11 in a state in which the second end portion 11F is nipped between the third surface 21C and the opposed portion 24. It is noted that the resistance heat elements 12, the cover 13 and the belt 3 are not illustrated in FIG. 2C and FIG. 3, as a matter of convenience.

In the longitudinal direction, a length of the first surface 21A is longer than the length of the heat conductive member 30. In the longitudinal direction, the length of the heat conductive member 30 is longer than a length of the roller 42 of the pressure roller 40. The roller 42 is located in a range in which the heat conductive member 30 is positioned in the longitudinal direction. That is, the roller 42 is located between the first end 38A and the second end 38B of the heat conductive member 30 in the longitudinal direction.

The second surface 21B and the third surface 21C are located at positions different from a position of the first surface 21A in the longitudinal direction. More specifically, the second surface 21B is located at the position on a first side with respect to the first surface 21A in the longitudinal direction. The third surface 21C is located at the position on a second side with respect to the first surface 21A in the longitudinal direction.

Figure 3:
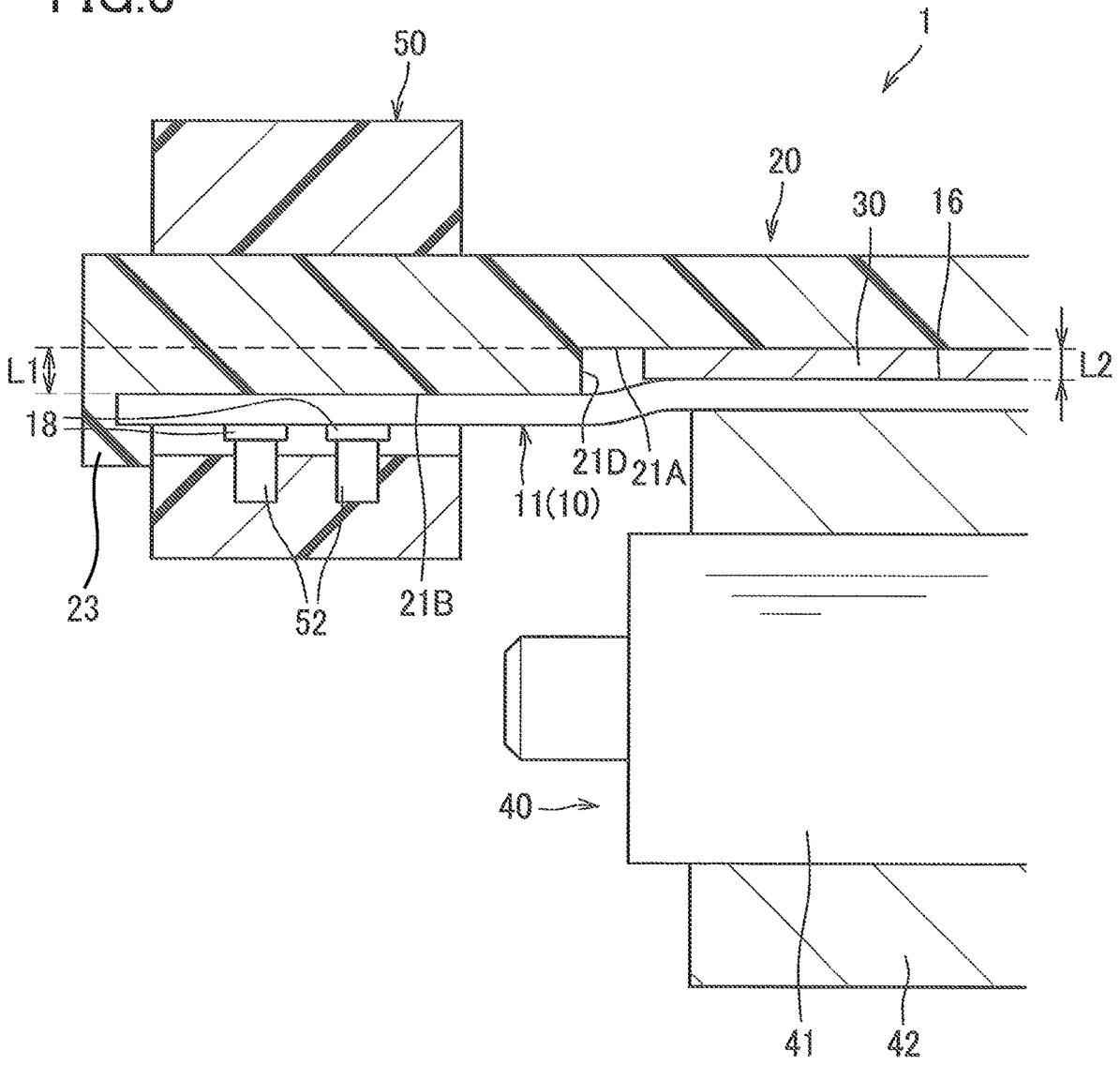
FIG. 3 is an enlarged cross-sectional view illustrating a configuration of a first end of the heating unit in the longitudinal direction.

The second surface 21B and the third surface 21C are disposed at the positions nearer to the heater 10 than the first surface 21A in a direction orthogonal to the first surface 21A. The second surface 21B and the third surface 21C are a same position in the direction orthogonal to the first surface 21A. That is, a distance between the second surface 21B and the heater 10 is the same as a distance between the third surface 21C and the heater 10 in the direction orthogonal to the first surface 21A. As illustrated in FIG. 3, a length of step L1 between the first surface 21A and the second surface 21B is greater than a thickness L2 of the heat conductive member 30. It is preferable that the thickness L2 of the heat conductive member 30 is 0.2 mm to 0.3 mm, and an example of the thickness L2 of the heat conductive member 30 is 0.3 mm. It is preferable that the length of step L1 between the first surface 21A and the second surface 21B is 0.4 mm to 0.5 mm, and an example of the length of step L1 between the first surface 21A and the second surface 21B is 0.4 mm. It is preferable that the length of step L1 is 0.1 mm to 0.2 mm greater than the thickness L2, and, for example, the length of step L1 is 0.1 mm greater than the thickness L2. It is noted that the deformed substrate 11 is illustrated in FIG. 2 and FIG. 3 so as to exaggerate a difference between the length of step L1 and the thickness L2 for convenience, however, in fact, the substrate 11 rarely deforms, since the difference between the length of step L1 and the thickness L2 is very small so that a crack of the substrate 11 of the heater 10 does not occurs.

Figure 4:
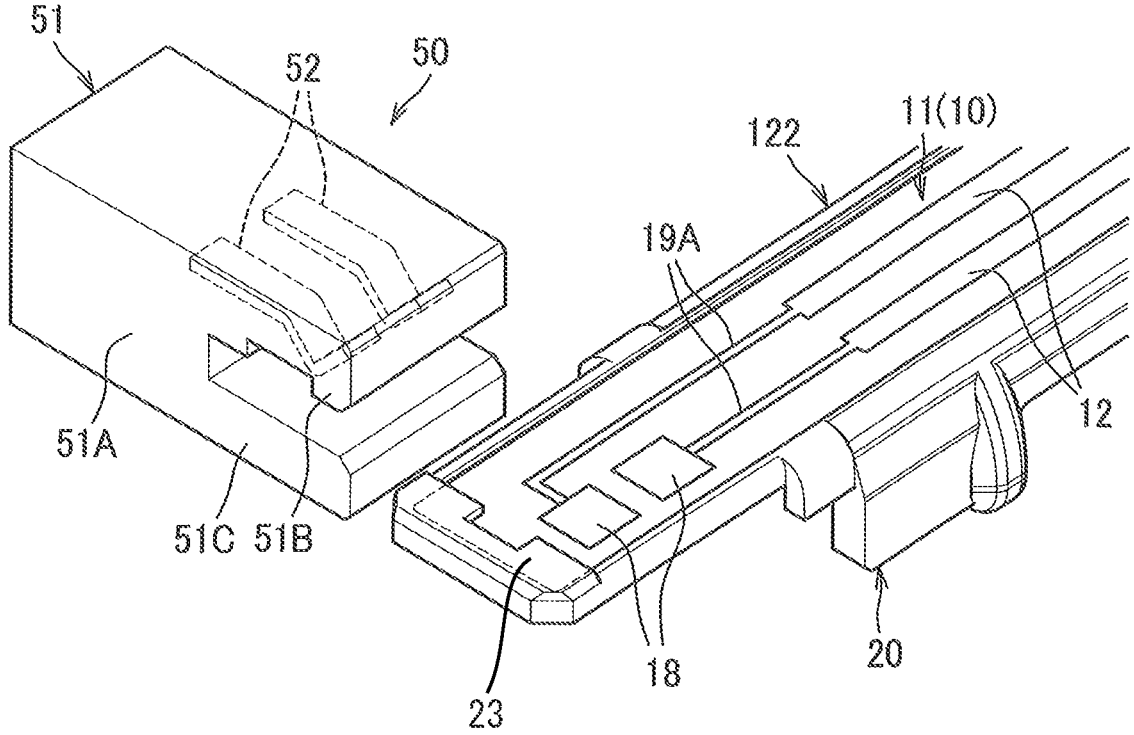
FIG. 4 is a perspective view illustrating a connector, a holder and the heater.

The heating unit 1 further includes a connector 50 configured to supply electricity to the heater 10. As illustrated in FIG. 4, the connector 50 includes a connector body 51 made of resin and the like, and two connecting terminals 52 made of conductive material such as metal.

The connecting terminals 52 are made of metal plates having elasticity. Each of the connecting terminals 52 is connected to the supply terminal 18 of the heater 10 (See FIG. 3). The two connecting terminals 52 are arranged with a space therebetween in the longitudinal direction of the heater 10.

The connector body 51 includes a base portion 51A having a rectangular parallelepiped shape, a first extending portion 51B extending in a direction directed from the base portion 51A toward the heater 10, and a second extending portion 51C extending in the direction directed from the base portion 51A toward the heater 10. The first extending portion 51B includes the connecting terminals 52. The first extending portion 51B and the second extending portion 51C are arranged with a space therebetween in a direction orthogonal to the nip surface 15 (See FIG. 1). The first extending portion 51B (more specifically, the connecting terminals 52) and the second extending portion 51C hold a first end of the heater 10 in the longitudinal direction and the first end of the holder 20 in the longitudinal direction from an upper side and a lower side of the heater 10 and the holder 20. In other words, the first end of the heater 10 in the longitudinal direction and the first end of the holder 20 in the longitudinal direction are interposed between the first extending portion 51B and the second extending portion 51C in the direction orthogonal to the nip surface 15. The connector 50 is mounted to the first end of the heater 10 and the first end of the holder 20 in the longitudinal direction from a first side of the heater 10 in the short-side direction.

As described above, it is possible to achieve the following effects in the present embodiment.

Since the length of step L1 between the first surface 21A and the second surface 21B is greater than the thickness L2 of the heat conductive member 30, it is possible that the first end of the heater 10 is in surface contact with the second surface 21B. Accordingly, it is possible to suppress variations of a contact pressure between the connecting terminal 52 and the supply terminal 18 from being increased when the connector 50 is mounted to the heater 10 and the holder 20.

Since the length of the heat conductive member 30 in the longitudinal direction is greater than the length of the resistance heat element 12 in the longitudinal direction, it is possible to uniformize the temperature of the heater 10 in an entire range in which the resistance heat element 12 is disposed.

Since the length of the first surface 21A in the longitudinal direction is greater than the length of the heat conductive member 30 in the longitudinal direction, even if the heat conductive member 30 thermally expands in the longitudinal direction due to the heater 10, it is possible to suppress the heat conductive member 30 from interfering the first step face 21D or the second step face 21E.

Since the heat conductive member 30 is made of aluminum or aluminum alloys so that the heat conductivity of the heat conductive member 30 increases, it is possible to more properly uniformize the temperature of the heater 10 in the longitudinal direction.

Since the length of the heat conductive member 30 in the longitudinal direction is greater than the length of the roller 42 of the pressure roller 40 in the longitudinal direction, it is possible to hold the heat conductive member 30 and the heater 10 between the pressure roller 40 and the holder 20 without a space in a state in which one of the pressure roller 40 and the holder 20 is urged toward the other of the pressure roller 40 and the holder 20. Accordingly, it is possible to suppress the heat conductive member 30 from moving between the holder 20 and the heater 10.

It is noted that the present disclosure is not limited to the above embodiment and various modification can be adopted as described below.

In the above described embodiment, the two supply terminals are disposed at the first end portion of the heater in the longitudinal direction, however, this disclosure is not limited to this configuration. For example, a plus terminal of the two supply terminals may be disposed at the first end portion of the heater in the longitudinal direction and a minus terminal of the two supply terminals may be disposed at a second end portion of the heater in the longitudinal direction. In this case, two connectors may be respectively disposed at the first end portion and the second end portion of the heater in the longitudinal direction.

In the above described embodiment, the step face is a face orthogonal to the longitudinal direction, however, this disclosure is not limited to this configuration. The step face may be an inclined face inclining with respect to the longitudinal direction.

In the above embodiment, the heat conductive member 30 is formed of one sheet-like member, however, the heat conductive member 30 may be formed of a combination of a plurality of sheet-like members. In this case, materials, heat conductivities, and shapes of the plurality of sheet-like members may be different from one another and may be the same as one another.

In the above embodiment, the substrate 11 of the heater 10 is formed of the long rectangular plate made of ceramic, however, the substrate 11 may be formed of a long rectangular plate, as long as a heat conductivity of which is less than that of the heat conductive member 30, made of metal such as stainless steel.

Respective components explained in the above embodiments and modifications may be arbitrarily combined to achieve the disclosure.

What is claimed is:

1. A heating unit, comprising:

a heater including a substrate, a resistance heating element provided on the substrate, and a supply terminal disposed at a first end of the substrate in a longitudinal direction of the heater, the supply terminal being electrically conducted with the resistance heating element;

an endless belt configured to rotate around the heater;

a pressure member, including a shaft and a roller covering a part of the shaft, wherein the belt is interposed between the pressure member and the heater;

a holder supporting the heater;

a heat conductive sheet located between the heater and the holder, the heat conductive sheet having a heat conductivity greater than that of the substrate; and a connector including a connecting terminal connected to the supply terminal, the connector being configured to hold a first end of the heater in the longitudinal direction and a first end of the holder in the longitudinal direction, wherein the holder includes a first surface located on a heater side and supporting the heat conductive sheet, and a second surface located on the heater side and supporting the first end of the heater, the second surface being located at a position different from a position of the first surface and nearer to the heater than the first surface in a direction orthogonal to the substrate, wherein a height of a step formed between the first surface and the second surface is greater than a thickness of the heat conductive sheet, and wherein a length of the heat conductive sheet in the longitudinal direction is greater than that of the roller of the pressure member.

2. The heating unit according to claim 1, wherein the supply terminal is located at a position spaced apart from the heat conductive sheet in the longitudinal direction, and wherein a length of the heat conductive sheet in the longitudinal direction is greater than that of the resistance heating element.

3. The heating unit according to claim 2, wherein a length of the substrate in the longitudinal direction is greater than that of the heat conductive sheet.

4. The heating unit according to claim 1, wherein a length of the first surface in the longitudinal direction is greater than that of the heat conductive sheet.

5. The heating unit according to claim 1, wherein the heat conductive sheet is made of aluminum or an aluminum alloy.

6. The heating unit according to claim 1, wherein a thickness of the heat conductive sheet is 0.2 mm to 0.3 mm.

7. The heating unit according to claim 1, wherein a height of the step is 0.4 mm to 0.5 mm.

8. The heating unit according to claim 1, wherein a height of the step is 0.1 mm to 0.2 mm greater than a thickness of the heat conductive sheet.

9. The heating unit according to claim 1, wherein the holder includes a third surface located on the heater side and supporting a second end of the heater in the longitudinal direction, the third surface being located at a position different from a position of the first surface and being the same position as the second surface in a direction orthogonal to the first surface.

10. The heating unit according to claim 1, wherein the connecting terminal is made of a metal plate having elasticity.

11. The heating unit according to claim 1, wherein two resistance heating elements are provided, and the two resistance heating elements are respectively disposed so as to extend in the longitudinal direction and so as to be spaced apart from each other in parallel in a short-side direction orthogonal to the longitudinal direction.

12. The heating unit according to claim 11, wherein the heater includes a conducting wire connected to a first end of each of the two resistance heating elements, and the supply terminal for supplying power is provided at an end portion of the conducting wire of each of the two resistance heating elements.

* * * * *